US008857447B2

(12) United States Patent
Heller

(10) Patent No.: US 8,857,447 B2
(45) Date of Patent: Oct. 14, 2014

(54) HAIR TREATMENT APPARATUS WITH COVER FOR CONTROL ELEMENTS

(71) Applicant: Conair Corporation, Stamford, CT (US)

(72) Inventor: Paulette Heller, Norwalk, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 13/687,416

(22) Filed: Nov. 28, 2012

(65) Prior Publication Data

US 2014/0144459 A1 May 29, 2014

(51) Int. Cl.

| | |
|---|---|
| ***A45D 20/08*** | (2006.01) |
| ***A45D 44/00*** | (2006.01) |
| ***A45D 20/12*** | (2006.01) |
| ***A45D 1/04*** | (2006.01) |
| ***A45D 2/36*** | (2006.01) |
| ***A45D 4/06*** | (2006.01) |
| ***A45D 4/12*** | (2006.01) |
| ***E05C 3/00*** | (2006.01) |
| ***E05C 9/00*** | (2006.01) |
| ***A45D 20/50*** | (2006.01) |

(52) U.S. Cl.

CPC ..... *A45D 20/50* (2013.01); *A45D 20/12* (2013.01)

USPC ..... 132/271; 132/333; 34/96; 219/222; 292/44

(58) Field of Classification Search

CPC ..... A45D 20/50; A45D 20/12

USPC ..... 132/271, 212, 211, 222–235, 269, 333; 219/222, 223, 225, 226, 227, 228, 229, 219/230; 34/96, 283; 392/379, 380, 384, 392/385; 292/1, 44, 251.5, DIG. 11, 292/DIG. 63; 174/66, 67; 49/373, 478.1, 49/507

See application file for complete search history.

(56) References Cited

U.S. PATENT DOCUMENTS

| | | | | |
|---|---|---|---|---|
| 3,288,511 | A | 11/1966 | Tavano | |
| 3,468,576 | A | 9/1969 | Beyer et al. | |
| 3,518,776 | A * | 7/1970 | Wolff et al. | 34/97 |
| 3,600,552 | A * | 8/1971 | Tolmie | 219/222 |
| 3,694,078 | A | 9/1972 | Bookless | |
| 3,790,197 | A | 2/1974 | Parker | |
| 3,846,047 | A * | 11/1974 | Wada et al. | 417/234 |
| 4,079,558 | A | 3/1978 | Gorham | |
| 4,477,716 | A * | 10/1984 | Thaler et al. | 219/225 |
| 4,629,131 | A | 12/1986 | Podell | |
| 4,658,547 | A * | 4/1987 | Oboza | 49/386 |
| 4,904,847 | A * | 2/1990 | Kosaka et al. | 392/384 |
| 4,941,236 | A | 7/1990 | Sherman et al. | |
| 4,977,306 | A * | 12/1990 | Kosaka et al. | 392/380 |

(Continued)

*Primary Examiner* — Vanitha Elgart

(74) *Attorney, Agent, or Firm* — Carter, DeLuca, Farrell & Schmidt LLP

(57) ABSTRACT

An apparatus for styling hair includes a handle frame, a treatment segment extending from the handle frame for applying treatment to hair of a subject, at least one control member disposed on the handle frame and a cover mounted to the handle frame. The cover is adapted to transition between an open position permitting access to the at least one control member and a closed position substantially enclosing the at least one control member, thereby protecting the at least one control member from moisture, hair treatment agents and/or contaminants. The cover may be dimensioned and adapted to be releasably secured in the closed position through magnetic or other mechanisms/methodologies.

14 Claims, 4 Drawing Sheets

(56) References Cited

U.S. PATENT DOCUMENTS

| | | | | |
|---|---|---|---|---|
| 5,040,162 | A * | 8/1991 | De Rozarieux et al. | 720/646 |
| 5,050,276 | A | 9/1991 | Pemberton | |
| 5,367,891 | A | 11/1994 | Furuyama | |
| 6,469,249 | B2 * | 10/2002 | Capella | 174/66 |
| 7,066,778 | B2 | 6/2006 | Kretzschmar | |
| 7,287,783 | B2 * | 10/2007 | Crossley | 292/35 |
| 7,486,165 | B2 | 2/2009 | Ligtenberg et al. | |
| 7,504,918 | B2 | 3/2009 | Prendergast et al. | |
| 7,649,701 | B2 | 1/2010 | Prendergast et al. | |
| 7,827,622 | B2 | 11/2010 | Claro | |
| 8,016,330 | B2 * | 9/2011 | Fullerton et al. | 292/251.5 |
| 8,242,364 | B1 * | 8/2012 | Shotey et al. | 174/66 |
| 2002/0149509 | A1 * | 10/2002 | Kim et al. | 341/176 |
| 2002/0190047 | A1 * | 12/2002 | Nam | 219/222 |
| 2004/0045570 | A1 * | 3/2004 | Yao | 132/224 |
| 2006/0243270 | A1 * | 11/2006 | Moskwa et al. | 126/194 |
| 2009/0044823 | A1 * | 2/2009 | Overend et al. | 132/211 |

* cited by examiner

HAIR TREATMENT APPARATUS WITH COVER FOR CONTROL ELEMENTS

BACKGROUND

1. Technical Field

The present invention relates to an apparatus for treating hair, and, in particular, relates to an apparatus including a cover for selectively enclosing control elements or switches associated with operation of the apparatus.

2. Description of Related Art

Hair treatment devices such as hairdryers and other appliances generally consist of a body fitted with a series of functional members. These may, in the case of a hairdryer, be elements intended for heating, generally electrically, the air which is circulated by a motor and a blower. The air is heated up on contact with heating elements (generally electrical resistive elements) and then expelled at the opposite end in the form of a stream of hot air. The outlet end is shaped or may be fitted with removable adapters so as to shape the stream of hot air released.

The apparatus includes a handle which is intended for manipulating the hairdryer. Other pieces of equipment of the same type, intended for hairdressing, such as styling brushes, curling irons or hair straighteners are shaped in a similar way. The handle incorporates a series of controls, usually switches in the form, for example, of slides, push-buttons or rocking switches for controlling various functions.

In the case of a hairdryer to which reference will be made by way of example hereinafter, one or more switches control the speed of the blower, for which it is common, for example, to have three positions (off, low speed and high speed). Other switches, which similarly have two and preferably three positions, control the heating. They generally have a position for switching the heating. function off, an intermediate position and a high-temperature position. In general, an additional switch is intended to give a "blast of cold air", that is to say, for a short period of time depending on the styling operation being performed, a stream of cold air. It is also commonplace for there to be a button for locking the set-up and starting it.

In some instances, it is commonplace to provide, for one or other function, knobs for progressive adjustment, switches of the sensitive type or push-buttons for adjusting the power. All these controls, that is to say controls for operating and for adjusting, are designed according to the type of appliance and its intended use. These controls, operating essentially as a series or array of switches or triggers, are usually fixed to the front part of the handle or are arranged to the side. In the case of a hairdryer, the controls are used by the operator who may be a third party (for example, a hairdresser) but may also be a person who wishes to style or dry their hair themselves.

However, these readily accessible switches or control elements are exposed to the external environment, and, thus are often subject to water or moisture, hair products or conditioners, etc. which may detract from the operator's ability to manipulate the control elements and/or damage the control elements.

SUMMARY

Accordingly, the present invention obviates the disadvantages of prior hair treatment apparatii. In accordance with one embodiment, the apparatus for styling hair includes a handle frame, a treatment segment extending from the handle frame for applying treatment to hair of a subject, at least one control member disposed on the handle frame and a cover mounted to the handle frame. The cover is adapted to transition between an open position permitting access to the at least one control member and a closed position substantially enclosing the at least one control member, thereby protecting the at least one control member from moisture, hair treatment agents and/or contaminants. The cover may be dimensioned and adapted to be releasably secured in the closed position. At least one of the handle frame and the cover includes a ferromagnetic material. First and second magnets may be mounted to one of the handle frame and the cover, and the other of the handle frame and the cover includes magnetically attractive material.

The cover may be mounted to the handle frame through at least one hinge. The cover may be adapted to pivot about the at least one hinge between the closed position and the open position. A gasket for establishing a seal between the cover and the handle frame when the cover is in the closed position may be provided.

The treatment segment may be a hair dryer blower for applying heated air to the hair of the subject where the blower depends from the handle frame. In the alternative, the treatment segment may include opposed hair straightener elements for applying a straightening effect on the hair. As a further alternative, the treatment segment may include a curling iron for applying a curling effect on the hair.

BRIEF DESCRIPTION OF THE DRAWINGS

Various embodiments of the present disclosure are described hereinbelow with references to the drawings, wherein.

DETAILED DESCRIPTION OF THE EMBODIMENTS

Figure 2:
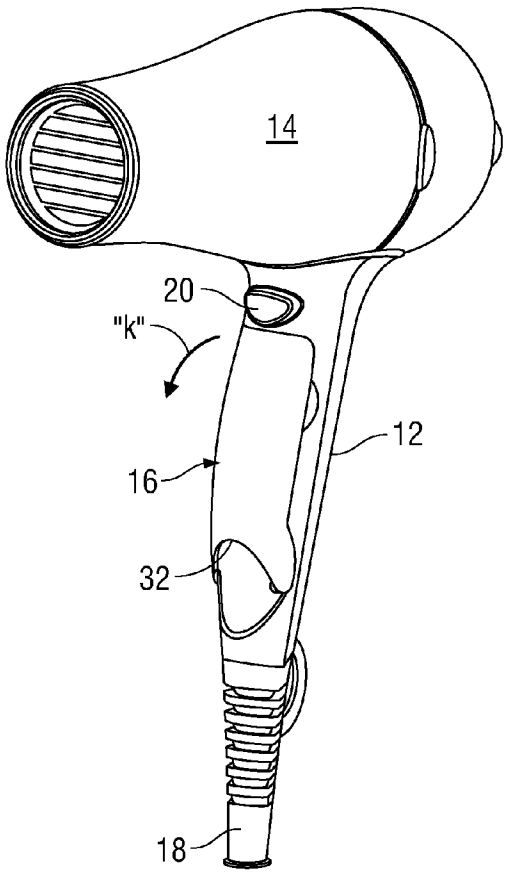
FIG. 2 is a perspective view similar to the view of FIG. 1 illustrating the cover in a closed position.
Figure 1:
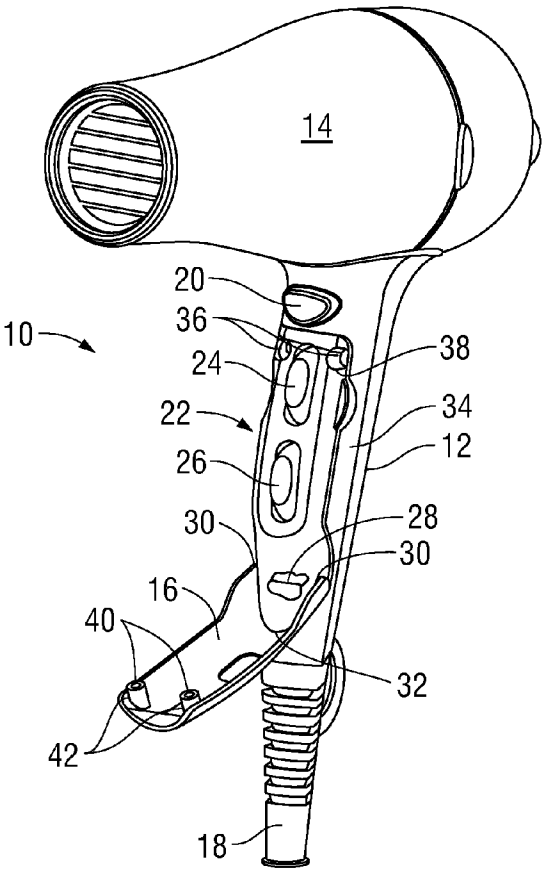
FIG. 1 is a perspective view of an apparatus for styling hair in the form of a blow dryer in accordance with the principles of the present disclosure illustrating the handle frame, the blower and the cover in an open position.

The device depicted in FIGS. 1 and 2 are perspective views of one illustrative embodiment incorporating the features of the present invention. In this embodiment, the invention is a hair dryer apparatus. The apparatus 10 includes a handle frame or hand grip 12, a treatment segment in the form of a barrel 14 depending from the handle frame 12 and a cover 16 which is mounted to the handle frame 12. A power lead 18 extends from the handle frame 12 to power the apparatus. The handle frame 12 includes a plurality of switches or control elements for controlling functioning of the apparatus 10. The switches or control elements may include a master switch 20 such as a power on/off switch. An array of controls 22 having at least one or two or more control elements or switches 24, 26 may be provided. In general, the first control element 24 may permit the speed of the air flow leaving the blower to be adjusted, in this instance by varying the rotational speed of the blower. The control element 26 may control the resistor elements to control the heating of the air being emitted by the barrel 14. Other switches or control elements for controlling auxiliary functioning of the apparatus 10 are also envisioned.

The cover 16 is connected to the handle frame 12 through at least one hinge element 28. The hinge element 28 may be a single pivot pin (see break away in FIG. 1) extending between both sides of the cover 14 and through openings 30 provided in the handle frame 12. The cover 16 is adapted to pivot about the at least one hinge element 28 between the open position depicted in FIG. 1 and the closed position depicted in FIG. 2. In the open position, the cover 16 permits access to the control elements 24, 26 while in the closed position, the control elements 24, 26 are substantially enclosed or confined by the cover 14. The cover 16 may define an arcuate contour on its outer shell to accommodate the control elements 24, 26 when the cover 16 is in the closed position. The cover 16 may further define an arcuate recess 32 at its lower surface and having a contour substantially corresponding to the segment of the outer dimension of the handle frame 12 adjacent the hinge element 30 to limit pivotal movement of the cover 14 to the generally orthogonal orientation relative to the handle frame 12 as depicted in FIG. 1 while providing a close tolerance between the two components. A gasket 34 of silicon rubber or other suitable elastomeric material may be provided on either the periphery of the cover 16 or circumscribing the area or location of the control elements 24, 26 on the handle frame 12 to establish a seal between the cover 16 and the handle frame 12 when the cover 16 is in the closed position of FIG. 2 to minimize potential of fluids or contaminants from entering this area during use and/or storage.

With continued reference to FIGS. 1 and 2, the cover 16 and/or handle frame 12 may include a mechanical fastener mechanism or an electro-mechanical mechanism for releasably securing the cover 16 in the closed condition of FIG. 2. In one embodiment, the handle frame 12 and the cover 16 include ferromagnetic or ferromagnetic materials to establish the releasable coupling. For example, the handle frame 12 may include at least one, e.g., two magnets or permanent magnets 36 adjacent the control element 22. The magnets 36 may be received within recessed segments 38 as shown. The cover 16 may include at least one, e.g., two fasteners, screws 40 or the like comprising a ferromagnetic material such as iron, nickel, cobalt or alloys thereof. The fasteners 40 may be disposed in raised fastener holders 42 depending from the interior of the cover 16. The raised fastener holders 42 are positioned and arranged to be received within recessed segments 38 when the cover 16 is in the closed position. This arranges the permanent magnets 36 and the fasteners 40 in position (e.g., contacting or non-contacting) to establish a magnetic coupling sufficient to retain the cover 16 in the closed position of FIG. 2. The magnetic coupling may be overcome through applying a predetermined physical force in the direction of directional arrow "k" (FIG. 2) on the cover 16 by grasping the outer edge of the cover 16, to permit movement of the cover 16 to the open position of FIG. 1.

In other embodiments, the magnets 36 may be located on the cover 16 and the ferromagnetic fasteners or screws 40 disposed on the handle frame 12. In another embodiment, the magnets 36 mounted to the handle frame 12 may be electromagnet powered through the power lead 18 or through an internal battery within the handle frame 12. For example, the electromagnet may be activated when the apparatus is powered via switch or control 20 and deactivated when the apparatus is not powered.

Figure 3:
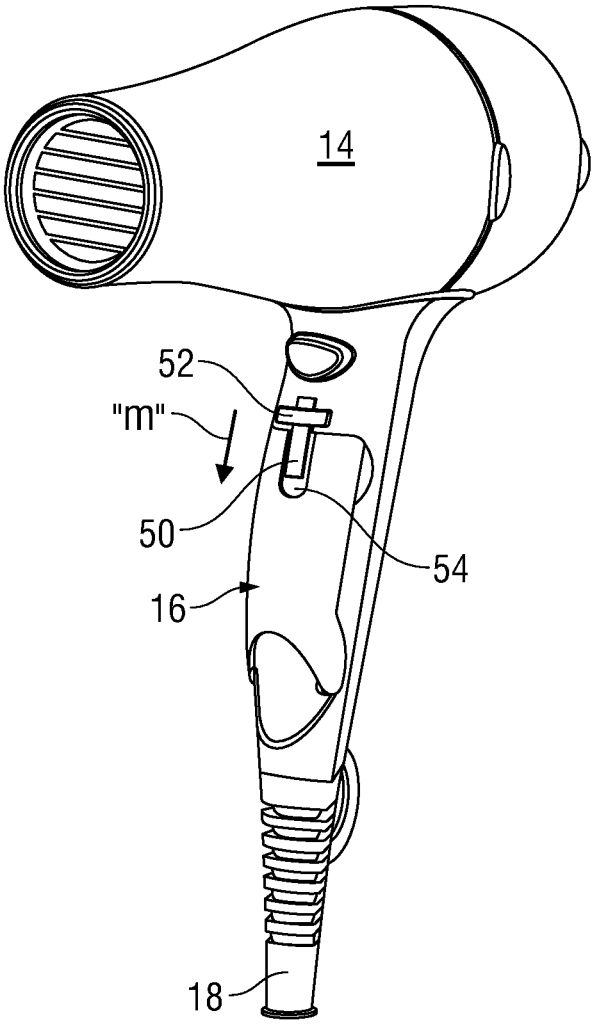
FIG. 3 is a perspective view of an alternate embodiment of the apparatus of FIG. 1 illustrating the cover in the closed position.

In another embodiment depicted in FIG. 3, the cover 16 may include a lock 50 which when in the releasably secured position depicted in FIG. 3, engages or is received beneath a corresponding locking detent, ledge or shelf 52 on the handle frame 12 to maintain the cover 16 in the closed position. To release the lock 50, the lock 50 is moved in a linear manner in the direction of directional arrow "m" until the lock releases the ledge 50 to permit the cover 16 to assume the open position. The lock 50 may reside in a recess 54 on the outer surface of the cover 16 and retained therein through conventional means. In the embodiment of FIG. 3, the lock 50 moves in a linear manner; it is envisioned, however, that the lock 50 may rotate about a pivot pin or the like to transition between the secured and unsecured positions with respect to the ledge 52.

Snap fit arrangements are also envisioned to releasably secure the cover 16 relative to the handle frame 12. For example, the fastener holders 42 of the embodiment of FIG. 1 may be dimensioned to be secured within the magnet holding recesses 38 of the handle frame 12 in snap fit relation or frictional relation sufficient to maintain the cover 16 in the closed position. To release the cover 16, a predetermined outward force is applied to the cover 16 to cause release of the snap fit or releasable coupling permitting opening of the cover 16. Other arrangements are also envisioned.

Figure 4:
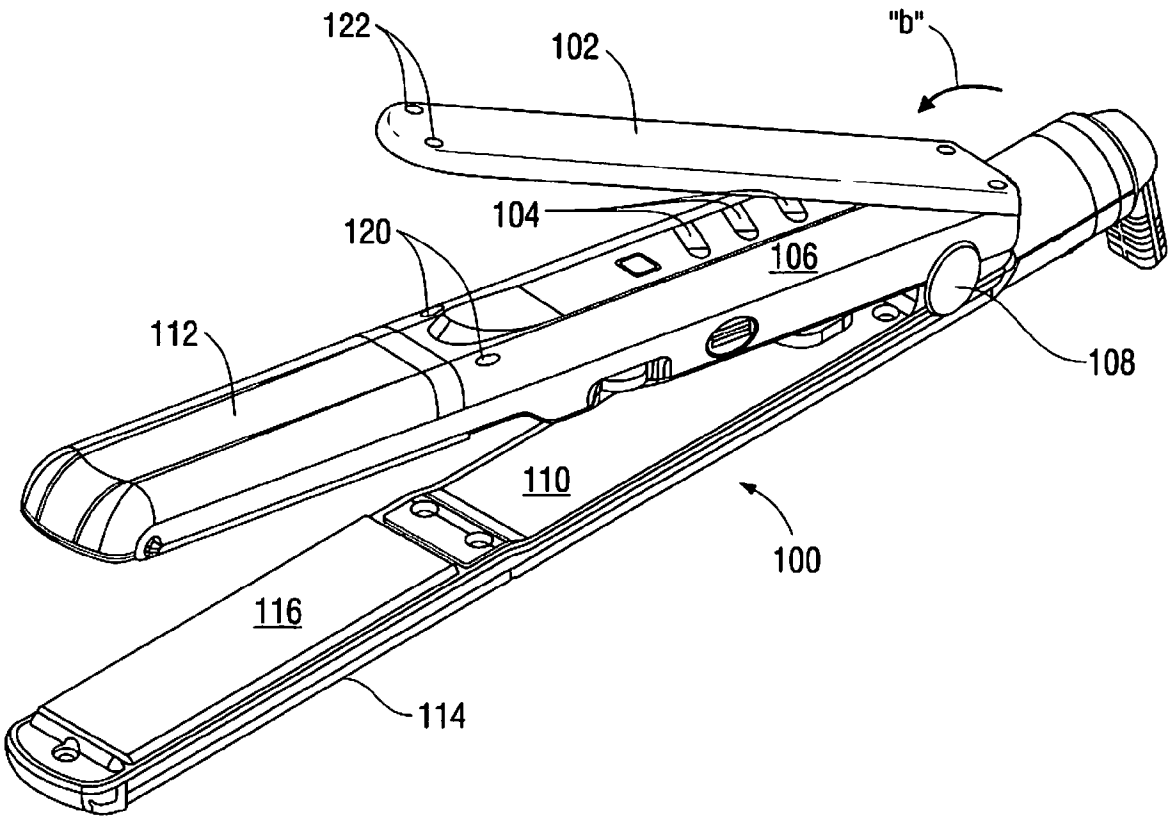
FIG. 4 is a perspective view of a hair straightener apparatus in accordance with an embodiment of the present disclosure incorporating a cover for selectively covering the control elements with the cover in the open position.

FIG. 4 illustrates a hair treatment apparatus in the form of a hair straightener or iron apparatus 100 which incorporates a cover 102 for selectively enclosing the control elements or switches 104 for operating the apparatus. Hair straightener apparatus 100 may be of the type disclosed in commonly assigned U.S. Pat. No. 7,178,532, the entire contents of which are incorporated by reference herein. Apparatus 100 includes handle portion 106 joined by spring-biased hinge 108, of a conventional type, to another handle portion 110. Respective head portions 112, 114 extend from the handle portions 106, 110 and are biased away from each other by the spring-biased hinge 108, as is known in the art. Each head portion 112, 114 has a heatable plate 116 heated by conventional electrical means (not shown) known in the art, so that hair can be positioned therebetween for styling. The handle portion 106 contains the control buttons or switches 104 to operate the apparatus 100. The cover 102 is mounted to the handle portion 106 and is adapted to pivot from the open position shown in FIG. 4 to a closed position about pivot pin or axis 120 in the direction of directional arrow "b" in much the same manner as the embodiment of FIG. 1, and is releasably maintained or secured in the closed position by any of the aforedescribed mechanisms/methodologies including, e.g., via a pair of magnets 120 on the handle portion 106 and cooperating ferromagnetic fasteners 122 or the like on the cover 102.

Figure 5:
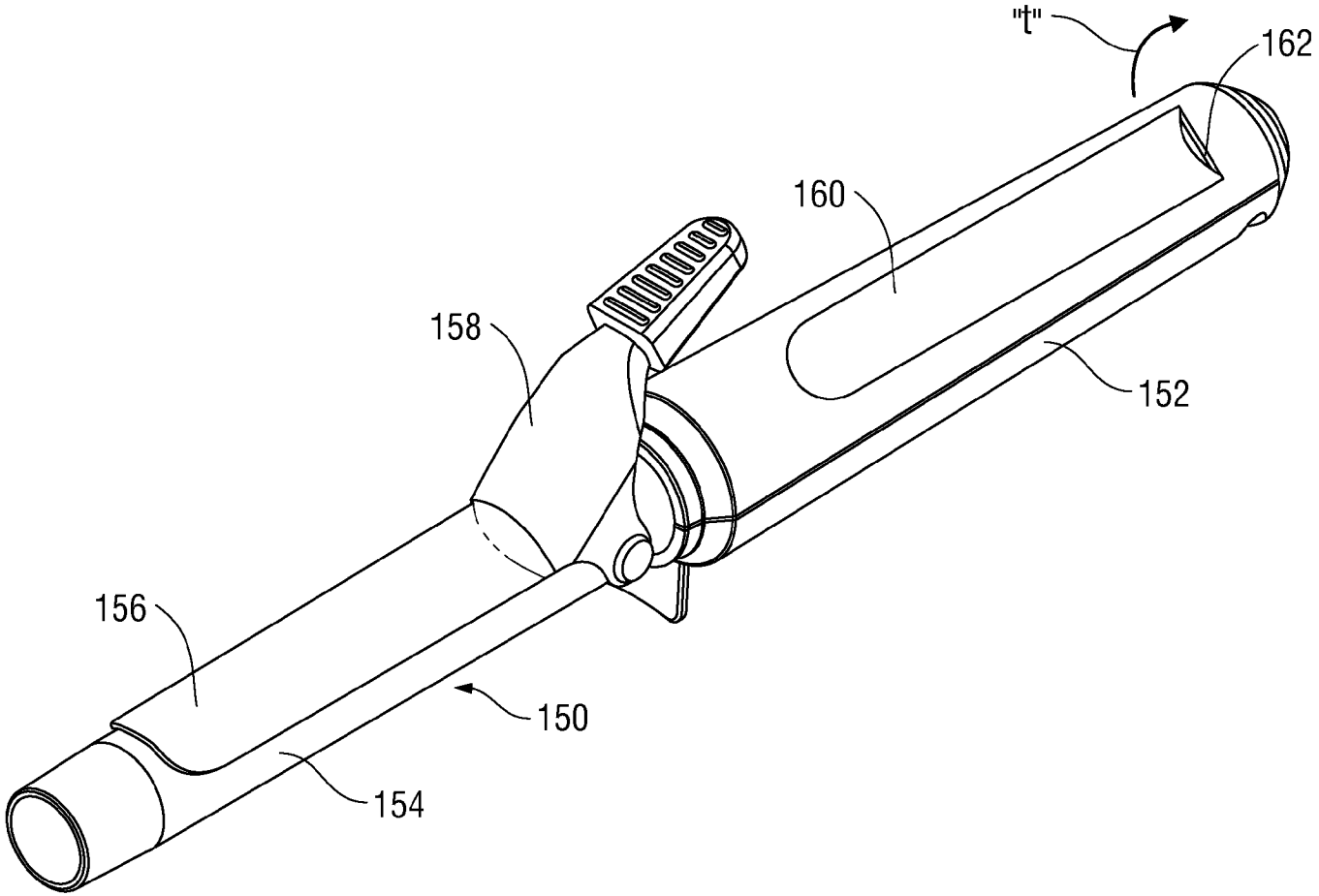
FIG. 5 is a perspective view of a hair curling apparatus in accordance with an embodiment of the present disclosure incorporating a cover for selectively covering the control elements with the cover in the open position.

FIG. 5 illustrates a hair treatment apparatus in the form of a hair curling iron apparatus 150 which incorporates a cover for selectively enclosing the control elements or switches for operating the apparatus. The hair curling iron apparatus 150 may be of the type disclosed in commonly assigned U.S. Pat. No. 4,731,519, the entire contents of which are incorporated by reference herein. The curling iron apparatus 150 includes a handle 152 and a treatment segment in the form of a cylindrical barrel 154. The handle 152 is of a generally cylindrical shape and the barrel 154 is in axial alignment with it. A hair clamp or spoon 156 is spring-pressed against a portion of barrel 154 and is controlled by spring-pressed control lever 158. Electrical resistance elements are provided for heating the barrel 154. A cover 160 is mounted to the handle 152 and is adapted to pivot from the closed position depicted in FIG. 5 in the direction of directional arrow "t" about a pivot pin or axis 162 to an open position in much the same manner as the embodiment of FIG. 1, and is releasably maintained or secured in the closed position by any of the aforedescribed mechanisms or methodologies. The cover 160 may enclose control elements (not shown) mounted on the handle 152 to minimize transfer of moisture, treatment agents or contaminants to this area.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. An apparatus for styling hair, which comprises:

a handle frame;

a treatment segment extending from the handle frame for applying treatment to hair of a subject;

first and second control members disposed on the handle frame, the first control member being a manually operable power switch adapted to activate and deactivate the treatment segment; and a cover mounted to the handle frame, the cover adapted to transition between an open position permitting access to the second control member and a closed position substantially enclosing the second control member while permitting access to the first control member.

2. The apparatus according to claim 1 wherein the cover is dimensioned and adapted to be releasably secured in the closed position.

3. The apparatus according to claim 2 wherein at least one of the handle frame and the cover includes a ferromagnetic material.

4. The apparatus according to claim 3 including first and second magnets mounted to one of the handle frame and the cover, and the other of the handle frame and the cover includes magnetically attractive material.

5. The apparatus according to claim 1 including a gasket for establishing a seal between the cover and the handle frame when the cover is in the closed position.

6. The apparatus according to claim 1 wherein the cover is mounted to the handle frame through at least one hinge, the cover adapted to pivot about the at least one hinge between the closed position and the open position.

7. The apparatus according to claim 1 wherein the treatment segment is a blower for applying heated air to the hair of the subject, the blower depending from the handle frame.

8. The apparatus according to claim 1 wherein the treatment segment includes opposed hair straightener elements for applying a straightening effect on the hair.

9. The apparatus according to claim 1 wherein the treatment segment includes a curling iron for applying a curling effect on the hair.

10. The apparatus according to claim 1 including a third control member disposed on the handle frame, the cover substantially enclosing the third control member when in the closed position thereof.

11. The apparatus according to claim 1 wherein one of the cover and the handle frame includes an electromagnet and the other of the cover and the handle frame includes a magnetically attractable material, wherein the electromagnet is activated when the treatment segment is powered via the first control member and wherein the electromagnet is deactivated when the treatment segment is not powered via the first control member.

12. An apparatus for styling hair, which comprises:

a handle frame;

a treatment segment including a blower extending from the handle frame for directing air to hair of a subject;

a power switch disposed on the handle frame for activating and deactivating the treatment segment;

a cover mounted to the handle frame, the cover adapted for movement relative to the handle frame between an open position and a closed position; and an electromagnet mounted with respect to one of the handle frame and the cover for releasably securing the cover to the handle frame, the electromagnet being activated when the power switch is in an on mode and the electromagnetic being deactivated when the power switch is in an off mode.

13. The apparatus according to claim 12 wherein the other of the handle frame and the cover includes ferromagnetic material for cooperating with the electromagnet.

14. The apparatus according to claim 13 including a control member mounted to the handle frame, the control member being enclosed by the cover when the cover is in the closed position thereof.

* * * * *